US007442152B2

(12) United States Patent
Peterson et al.

(10) Patent No.: US 7,442,152 B2
(45) Date of Patent: Oct. 28, 2008

(54) CYCLIST TRAINING SYSTEM

(76) Inventors: Lewis Dale Peterson, 3428 Sycamore, San Luis Obispo, CA (US) 93401; Christopher Todd Maglio, 490 Whidbey St., Morro Bay, CA (US) 93442; Brian Doyle Miller, 2580 Spyglass Dr., #E, Shell Beach, CA (US) 93449

( * ) Notice: Subject to any disclaimer, the term of this patent is extended or adjusted under 35 U.S.C. 154(b) by 747 days.

(21) Appl. No.: 11/106,771

(22) Filed: Apr. 14, 2005

(65) Prior Publication Data

US 2006/0234839 A1 Oct. 19, 2006

(51) Int. Cl.
*A63B 69/16* (2006.01)

(52) U.S. Cl. ..... 482/57; 482/61

(58) Field of Classification Search ..... 482/51, 482/57, 61; 601/36; D21/663, 664; 434/61, 434/67

See application file for complete search history.

(56) References Cited

U.S. PATENT DOCUMENTS

| | | | | |
|---|---|---|---|---|
| 4,415,152 | A | 11/1983 | Smith | 272/73 |
| 4,572,502 | A | 2/1986 | Messineo | 272/73 |
| 4,580,983 | A | 4/1986 | Cassini et al. | 434/61 |
| 4,955,600 | A | 9/1990 | Hoffenberg et al. | 272/73 |
| 4,958,832 | A | 9/1990 | Kim | 272/73 |
| 5,240,417 | A | 8/1993 | Smithson et al. | 434/61 |
| 5,364,271 | A | 11/1994 | Aknin et al. | 434/61 |
| 5,533,899 | A * | 7/1996 | Young | 434/61 |
| 6,004,243 | A | 12/1999 | Ewert | 482/8 |
| 6,322,480 | B1 * | 11/2001 | Lim et al. | 482/57 |
| 6,530,864 | B1 | 3/2003 | Parks | 482/5 |
| 7,326,151 | B2 * | 2/2008 | Peterson et al. | 482/61 |
| 2002/0055422 | A1 | 5/2002 | Airmet et al. | 482/61 |
| 2003/0073546 | A1 | 4/2003 | Lassanske et al. | 482/63 |
| 2004/0053751 | A1 * | 3/2004 | Pizolato | 482/61 |
| 2005/0209064 | A1 | 9/2005 | Peterson | |

FOREIGN PATENT DOCUMENTS

| | | | |
|---|---|---|---|
| JP | 06385182 | A | 10/1994 |

* cited by examiner

*Primary Examiner*—LoAn H. Thanh
*Assistant Examiner*—Tam Nguyen
(74) *Attorney, Agent, or Firm*—Philip Steiner, Esq.

(57) ABSTRACT

A cyclist training system having a polymeric pivoting assembly which is adapted to allow a cyclist of a bicycle to nutate about the perpendicular axis when exerting lateral forces on the bicycle. The cyclist training system includes a tubular base support, a tubular bicycle support; and means to securely retain the bicycle within the cyclist training system. The polymeric pivoting assembly couples the tubular bicycle support to the tubular base support and is constructed from a polyurethane elastomer. Various embodiments of the polymeric pivoting assembly are provided having Shore A hardness in the range of 40-90 durameters and Shore D hardness in the range of 45-65 durameters. The polymeric pivoting assembly minimizes the unnatural bounce provided by other cyclist training systems known in the relevant art.

29 Claims, 4 Drawing Sheets

CYCLIST TRAINING SYSTEM

CROSS-REFERENCE TO RELATED APPLICATIONS

Not Applicable

FEDERALLY SPONSORED RESEARCH AND DEVELOPMENT

Not Applicable

REFERENCE TO A MICORFICHE APPENDIX

Not Applicable

FIELD OF INVENTION

The present invention relates generally to a bicyclist training system, and more specifically to a bicyclist training system which allows stationary use and variable resistance training of a cyclist while providing realistic feedback to the cyclist based on forces exerted by the cyclist while training on the bicycle.

BACKGROUND

Stationary cyclist training systems using a cyclist's actual bicycle to train indoors are known in the relevant art. In many cases, the training systems available in the relevant art prevent or unnaturally restrict the lateral movement of the bicycle which impacts the training received by the cyclist. For example, a cyclist may rise off the seat of the bicycle and "stand" on the pedals to exert the greatest amount of downward force.

This and other commonly encountered training situations are important to the cyclist since unintended lateral forces are transmitted to the bicycle in conjunction with the alternating downward forces. These dynamic lateral forces require the development of proper muscle memory and automatic recognition of the physio-kinetic sensations necessary to compensate for the potential loss of balance and/or optimization of cycling performance.

By preventing or otherwise unnaturally restricting the lateral movement of the bicycle, the normally experienced sensations provided to the cyclist in response to the level of force being exerted on the bicycle are lost, resulting in less than satisfactory training as only the major muscle groups become exercised. The smaller muscle groups used in maintaining balance, control and "fine tuning" of exertion of forces are not significantly exercised.

In other cases, the mechanical restrains used to maintain the bicycle within the training system presents attenuated and unrealistic feedback forces to the cyclist thus limiting the effectiveness of the stationary training system.

Therefore, a stationary training system which presents realistic feedback forces in response to a cyclists' level of exertion

SUMMARY

The invention addresses the limitations described above and provides a bicycle training system that provides realistic sensory feedback to a cyclist based on forces exerted by the cyclist on the bicycle. In a first aspect of the invention, a cyclist training system is provided which incorporates a base support means; a polymeric pivoting means coupled to said base support means; a bicycle support means coupled to the polymeric pivoting means at a first end and to a bicycle coupling means at a second end; and a resistance means coupled to the bicycle support means in proximity to the first end.

In an embodiment of the invention the base support means comprises a tubular member having a generally hyperboloid shape.

In a related embodiment of the invention, the polymeric pivoting means comprises at least one insert constructed of an organic polymer having Shore A scale hardness in the range of 40-90 durameters inclusive.

In another related embodiment of the invention, the bicycle support means comprises a tubular member having a generally hyperboloid shape with a flange member mounted in proximity to a base of the hyperboloid shape.

In another related embodiment of the invention, the bicycle coupling means comprises a pair of adjustable securing members mounted in opposition along a common lateral axis above the base support means.

In another related embodiment of the invention, the pair of adjustable securing members being extendable over both sides of a wheel axle of the bicycle disposed between the pair of adjustable securing members.

In yet another related embodiment of the invention, the polymeric pivoting means is adapted to provide sufficient rigidity to maintain the bicycle in an axis generally perpendicular to the base support means but providing sufficient flexibility to allow a cyclist of the bicycle to nutate about the perpendicular axis when exerting lateral forces on the bicycle.

In a final related embodiment of the invention, the resistance means comprises a variable friction device which when abutted against a wheel of the bicycle provides sufficient drag to the wheel to simulate various riding conditions.

In another aspect of the invention, a cyclist training system is provided which incorporates a tubular base support having a first end, a second end and a generally planar mounting surface disposed at about a midpoint between the first end and the second end;

A tubular bicycle support is further provided having a first end with a first adjustable securing member mounted perpendicularly to the tubular bicycle support; a second end with a second adjustable securing member mounted perpendicularly to the tubular bicycle support; the first and the second adjustable securing members being aligned in opposition along a common lateral axis above the tubular base support and a generally planar flange disposed at about a midpoint between the first end and the second end and aligned generally in parallel to the generally planar mounting surface.

A polymeric pivoting assembly is further provided which is adapted to pivotally couple the generally planar flange to the generally planar mounting surface. An adjustable resistance unit is further provided and is coupled to the tubular bicycle support at a position adjacent to the generally planar flange.

In a related embodiment of the invention, the polymeric pivoting assembly comprises at least one insert is constructed of an organic polymer having Shore A scale hardness in the range of 40-90 durameters inclusive. In another related embodiment of the invention, the polymeric pivoting means comprises a plurality of organic polymeric inserts including; a first portion of said plurality of organic polymeric inserts having a Shore A scale hardness in the range of 40-90 durameters inclusive; and a second portion of said plurality of organic polymeric inserts having a Shore D scale hardness in the range of 45-65 durameters inclusive.

In another related embodiment of the invention, the polymeric pivoting assembly comprises a cover plate, a first polymeric insert disposed between the cover plate and a top surface of the generally planar flange, a second polymeric insert disposed between a bottom surface of the generally planar flange and a top surface of the generally planar mounting surface, and at least one fastener which couples the polymeric pivoting assembly to at least the generally planar mounting surface.

In yet another related embodiment of the invention, the organic polymer consists essentially of shock absorbing polyurethane.

In a final related embodiment of the invention, the adjustable resistance unit is repositionable to fit a wheel of said bicycle having a diameter in the range of 16" to 29" inclusive.

In another aspect of the invention, a cyclist training system is provided which incorporates a tubular base support having a generally hyperboloid shape with a first end, a second end and a generally planar mounting surface disposed at about a midpoint between the first end and the second end.

A tubular bicycle support is further provided having a generally hyperboloid shape with a first end including a first adjustable securing member mounted perpendicularly to the tubular bicycle support and a second end including a second adjustable securing member mounted perpendicularly to the tubular bicycle support where the first and the second adjustable securing members are aligned in opposition along a common lateral axis above the tubular base support.

A generally planar flange is further provided and is disposed at about a midpoint between the first end and the second end and aligned generally in parallel to the generally planar mounting surface.

A polymeric pivoting assembly is further provided which is adapted to pivotally couple the generally planar flange to the generally planar mounting surface such that the polymeric pivoting assembly provides sufficient rigidity to maintain the bicycle in a generally perpendicular axis to the base support but having sufficient flexibility to allow a cyclist of the bicycle to nutate about the perpendicular axis when exerting lateral forces on the bicycle.

An adjustable resistance unit is further provided and is coupled to the tubular bicycle support at a position adjacent to the generally planar flange.

In a related embodiment of the invention, the polymeric pivoting assembly comprises at least one insert is constructed of an organic polymer having Shore A scale hardness in the range of 40-90 durameters inclusive. In another related embodiment of the invention, the polymeric pivoting means comprises a plurality of organic polymeric inserts including; a first portion of said plurality of organic polymeric inserts having a Shore A scale hardness in the range of 40-90 durameters inclusive; and a second portion of said plurality of organic polymeric inserts having a Shore D scale hardness in the range of 45-65 durameters inclusive.

In another related embodiment of the invention, the polymeric pivoting assembly comprises a cover plate, a first polymeric insert disposed between the cover plate and a top surface of the generally planar flange, a second polymeric insert disposed between a bottom surface of the generally planar flange and a top surface of the generally planar mounting surface, and at least one fastener which couples the polymeric pivoting assembly to at least the generally planar mounting surface.

In another related embodiment of the invention, the at least the first adjustable securing member comprises a cylindrical locking mechanism which engages one side of an axle of the bicycle along a common axis with the second adjustable securing member sufficient to securely maintain the bicycle in the cyclist training system during use.

In another related embodiment of the invention, the second adjustable securing member is similar to the first securing member but arranged to engage an opposite side of the axle such that the first and the second adjustment members securely maintain the bicycle in the cyclist training system during use cooperatively.

In another related embodiment of the invention, the tubular bicycle support is disposed at an angle from the tubular base support in a range of 35 to 70 degrees inclusive.

In another related embodiment of the invention, at least a portion of the first and the second ends of the tubular base support are enclosed in anti-skid polymeric boots.

BRIEF DESCRIPTION OF DRAWINGS

The features and advantages of the invention will become apparent from the following detailed description when considered in conjunction with the accompanying drawings. Where possible, the same reference numerals and characters are used to denote like features, elements, components or portions of the invention. Optional components are generally shown in dashed lines. It is intended that changes and modifications can be made to the described embodiment without departing from the true scope and spirit of the subject invention as defined in the claims.

DETAILED DESCRIPTION

This present invention provides a stationary bicycle training system which provides realistic force feedback to a cyclist as is described in the various aspects and embodiments of the inventions provided below.

Figure 1:
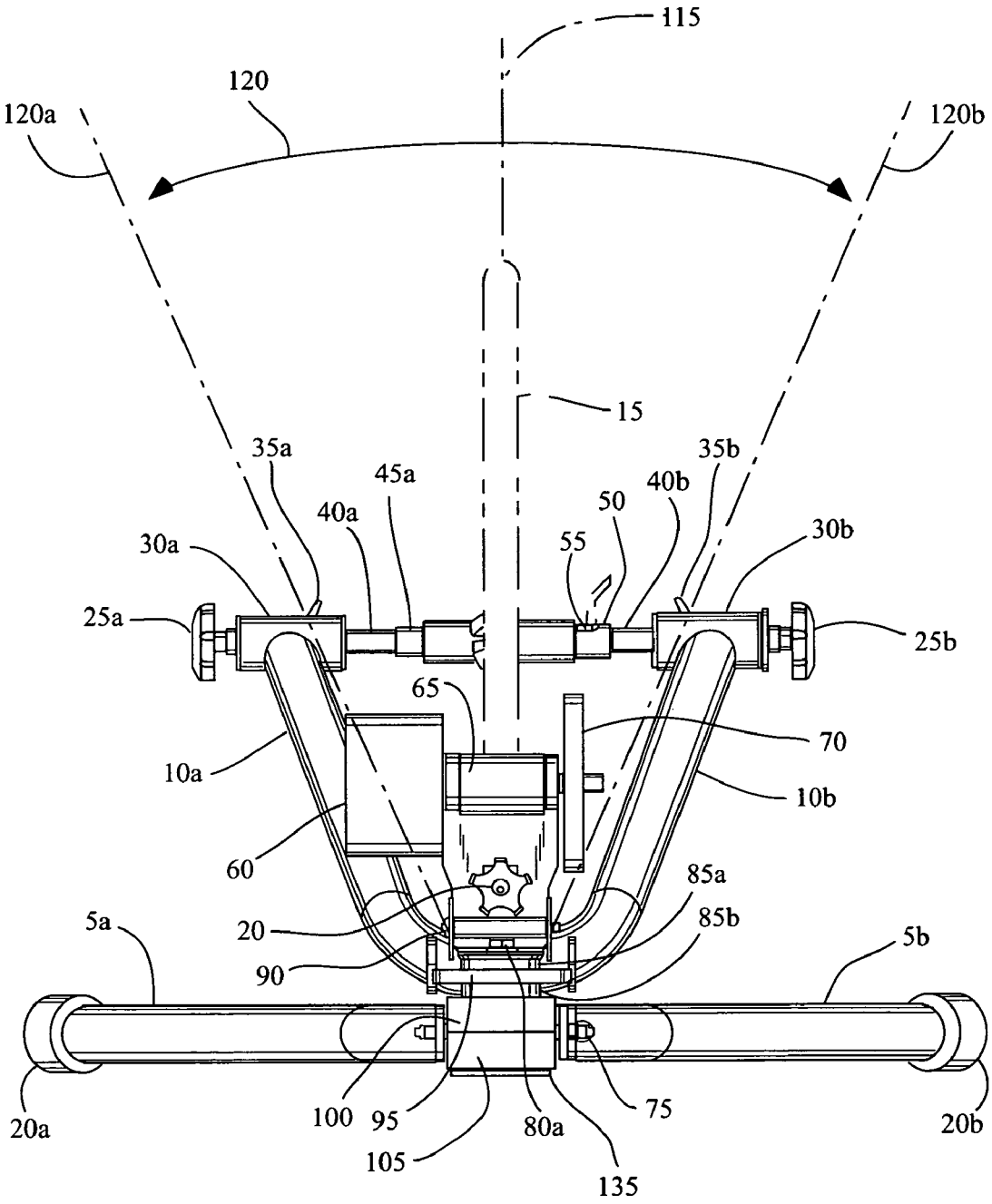
FIG. 1—depicts a frontal view of the invention.

Referring to FIG. 1, a front view of the cyclist training system is depicted. The invention includes a tubular steel base support 5*a*, 5*b* arranged in either a "V" or "U" configuration, generically referred to as a hyperboloid. The base support 5*a*, 5*b* is intended to be placed on a generally planar horizontal surface during use. Each end of the base support 5*a*, 5*b* incorporates a polymeric boot 20*a*, 20*b* for shock absorbance of forces exerted by a cyclist, and prevention of skidding and chafing on the horizontal surface during use. The base support 5*a*, 5*b* incorporates a generally horizontal mounting plate 100 coupled to an anterior surface at the base of the "V" or "U" (hyperboloid).

The mounting plate 100 incorporates a metal block which forms a split clamp assembly 130 along with the lower metal block 105. The split clamp assembly 130 is held in position for use by the locking pin 75. A polymeric skid pad 135 is attached to the underside of the lower metal block. In a preferred embodiment of the invention, the polymeric skid pad is attached by adhesive. The polymeric boots 20*a*, 20*b* and the polymeric skid pad 135 forms a stable 3 point triangular base which prevents sliding of the cyclist training system and marring or chafing of a floor.

The mounting plate 100 is constructed of metal and provides the common mounting point for the majority of components incorporated into the invention. A second tubular steel bicycle support 10*a*, 10*b* is provided which is likewise arranged in either a "V" or "U" (hyperboloid) configuration.

The bicycle support 10*a*, 10*b* pivotally attaches to the mounting plate 100 by way of a metal flange 95 attached to an anterior surface at the base of the "V" or "U" (hyperboloid.)

Pivoting action of the metal flange 95 and attached tubular bicycle support 10*a*, 10*b* is accomplished by placing polymeric inserts 85*a*, 85*b* between the mounting plate 100 and metal flange 95 and between the metal flange 95 and a metal cover plate 110. The metal flange 95 and polymeric inserts 85*a*, 85*b* become a type of swash plate assembly which allows limited lateral mobility 120 from perpendicular 115 and/or nutation while providing sufficient rigidity to maintain the bicycle within a safe range of motion.

The polymeric inserts 85*a*, 85*b* are constructed to isolate the tubular bicycle support 10*a*, 10*b* from direct metal to metal contact with the tubular base support 5*a*, 5*b*, provide shock absorbance, and provide realistic feedback forces in response to forces exerted by a cyclist on the bicycle being used for training.

The feedback forces are returned by the resilient properties of the polymer and are transmitted to the frame of the bicycle to which the wheel 15 is attached.

In an embodiment of the invention, the polymer is constructed from polyurethane having sufficient plasticizer to produce an elastomer having a hardness of approximately 60 durameters when measured using the Shore A scale. The exact hardness may be adjusted to suit individual training needs and goals.

As such, an elastomer having hardness in the inclusive range of 40-90 durameters (Shore A scale) is believed adequate to meet the varying individual training needs and goals.

Likewise, the thickness of the polymeric inserts 85*a*, 85*b* may vary individually or uniformly in the inclusive range of 0.25 inches to 1.5 inches. While polymeric sheets are described herein for cost considerations, one skilled in the art will appreciate that non-planar surfaces such as ellipsoids and polygons may be used to further fine tune the feedback response provided by the polymer inserts 85*a*, 85*b*.

The entire pivoting assembly is securely attached to the mounting plate 100 using one or more fasteners 80*a* which perpendicularly traverse through the metal cover plate 110, polymeric inserts 85*a*, 85*b* and metal flange 95.

An adjustable resistance unit 60, having a contact shaft 65 and flywheel 70 is adjustably attached 90 to the tubular bicycle support 10*a*, 10*b* at point adjacent to the mounting flange 95.

The adjustable resistance unit 60 is mounted 90 on an adjustable spring loaded assembly 20 which causes a contact shaft 65 to engage the wheel 15 of the bicycle.

The contact shaft 65 is aligned such that engagement of the wheel 15 occurs at about an axis generally perpendicular to the wheel 15 and essentially parallel to the base support 5*a*, 5*b*.

Suitable adjustable resistance units 60, including the contact shaft 65 and flywheel 70 are commercially available from Kurt Kinetic, 395 Ervin Industrial Drive, Jordan, Minn. 55352; and Saris/CycleOps, 5253 Verona Road, Madison, Wis. 53711, . The adjustable resistance unit 60 may used with wheel sizes in the inclusive range of 16" to 29".

The tubular bicycle support 10*a*, 10*b* has mounted at each end of the "V" or "U" shape, wheel securing assemblies 30*a*, 30*b*. The wheel securing assemblies 30*a*, 30*b* are aligned along a common axis, generally perpendicular to vertical plane of the wheel 15 and generally in parallel with base support 5*a*, 5*b*.

The left wheel securing assembly 30*a* incorporates a hand operated screw drive assembly 25*a*, a screw drive assembly lock 35*a*, support rod 40*a* and a left axle sleeve 45. The axle sleeve 45 is designed to encompass the left (non-levered) side of a standard axle quick release mechanism.

The right wheel securing assembly 30*b* incorporates a hand operated screw drive assembly 25*b*, a screw drive assembly lock 35*b* (not shown), a support rod 40*b* and an axle sleeve 50. The right axle sleeve 50 is designed to encompass the right (levered) side of an axle quick release mechanism and incorporates a slot 55 to allow the lever of a quick release mechanism to protrude therethrough. One skilled in the art will appreciate that the left and right sleeves 45, 50 may be replaced with appropriately sized sockets to fit the axle nuts of wheels not equipped with standard quick release mechanisms or other adapters for specialized applications.

Figure 2:
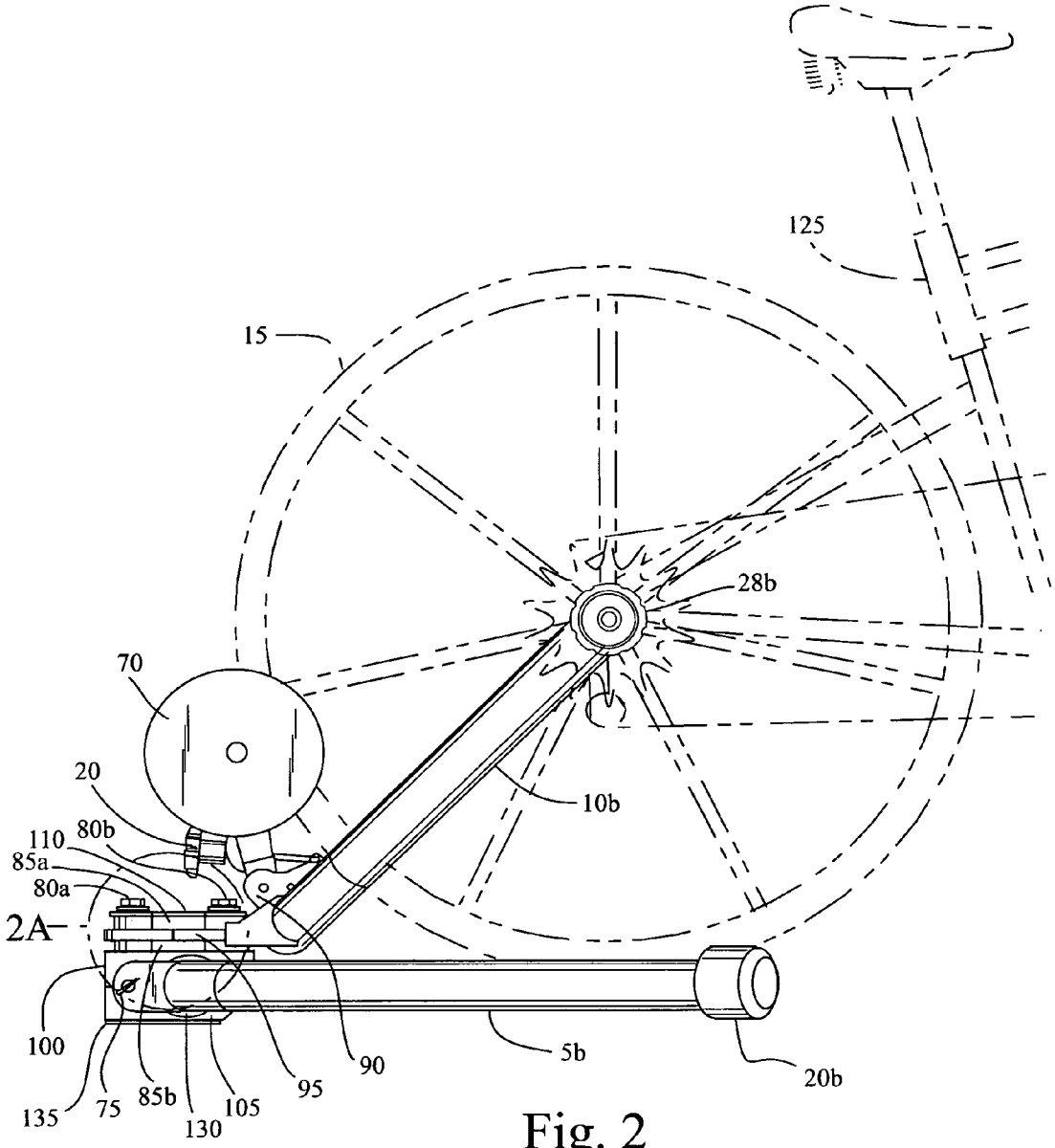
FIG. 2—depicts a side view of the invention.

Referring to FIG. 2, a left side view of the invention is depicted where the wheel 15 is maintained by the tubular bicycle support 10*b*. The placement 90 of the resistance unit 60, which is obscured from view by the flywheel 70, is shown adjacent to the mounting flange 95.

The amount of resistance desired by the cyclist may be adjusted using the knob provided included with the adjustable spring loaded assembly 20.

The tubular support 10*b* is depicted at an angle relative to the base support 5*b*. In the preferred embodiment of the invention, this angle is approximately 45 degrees but may vary in the inclusive range of 35 to 70 to accommodate wheel sizes varying outside the inclusive range of 16" to 29".

Figure 4:
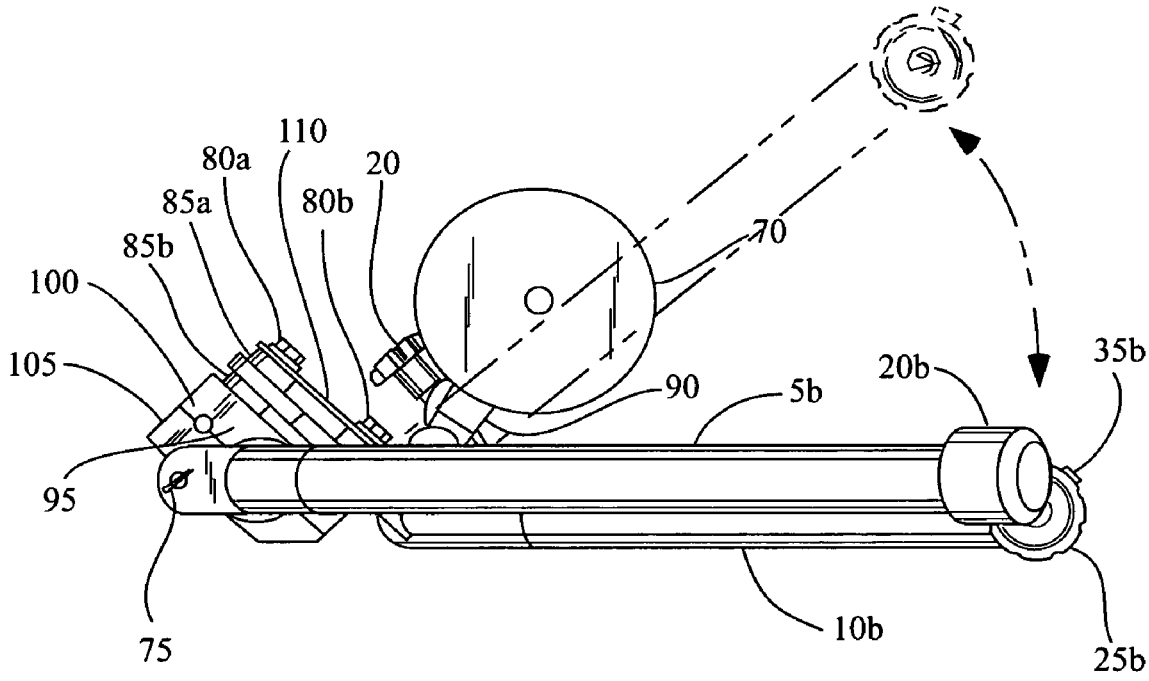
FIG. 4—depicts another side view of the invention.

A pair of fasteners 80*a*, 80*b* is used to securely attach the pivoting assembly described above to the mounting plate 100. As previously described, in one embodiment of the invention, the mounting plate 100 and lower metal block 105 disposed at the forward midpoint of the tubular steel base support 5*a*, 5*b* comprise a lateral split clamping assembly 130 which allows rotation of the tubular bicycle support 10*a*, 10*b* into a common plane with the tubular steel base support 5*a*, 5*b*. The lateral split clamping assembly 130 is maintained in a use position by the locking pin 75. Removal of the locking pin 75 allows the lateral clamping assembly 130 to swivel about the lateral axis of the base support 5*b*. This feature is advantageous to reduce the vertical profile, by allowing the bicycle support 10*b* and attached components to swivel downward toward the same lateral plane as the base support 5*b*. A polymeric skid pad 135 is attached to the underside of the lower metal block 105 to prevent movement of the cyclist training system during use. The final arrangement of the cycling system after implementing the swiveling feature is depicted in FIG. 4.

Figure 2A:
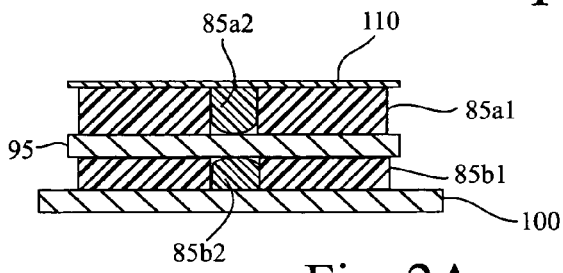
FIG. 2A—depicts a shock absorbing embodiment of the invention.

Referring to FIG. 2A, a cross section of the polymeric inserts 85*a*, 85*b* is depicted. In this embodiment of the invention, the upper polymeric insert 85*a* is divided into a plurality of components 85*a*1, 85*a*2. The first upper component 85*a*1 has a different hardness than the second upper component 85*a*2. In this embodiment of the invention, the first upper component 85*a*1 is constructed of a softer polymeric material having a Shore A hardness in the range of 40-90 durameters. The second upper component 85*a*2 having a Shore D hardness in the range of 45-65 durameters. The second upper component 85*a*2 further includes a convex surface which variably engages the top surface of the mounting flange 95.

This arrangement is intended to further reduce or eliminate the unnatural bounce inherent in many of the relevant art cyclist training systems.

In further related embodiment of the invention, the lower polymeric insert 85*b* is likewise divided into a plurality of components; a first lower component 85*b*1 and second lower component 85*b*2. The first lower component 85*b*1 has a different hardness than the second lower component 85*b*2. In this further embodiment of the invention, the first lower component 85*b*1 is constructed of a softer polymeric material having a Shore A hardness in the range of 40-90 durameters. The second lower component 85*a*2 having a Shore D hardness in the range of 45-65 durameters. The second lower component 85*b*2 further includes a convex surface which variably engages the underside surface of the mounting flange 95. This arrangement is intended to further reduce or eliminate the unnatural bounce inherent in many of the relevant art cyclist training systems. In this embodiment of the invention, the first component 85*a*1 is constructed of a softer polymeric material having a Shore A hardness in the range of 40-90 durameters.

Figure 3:
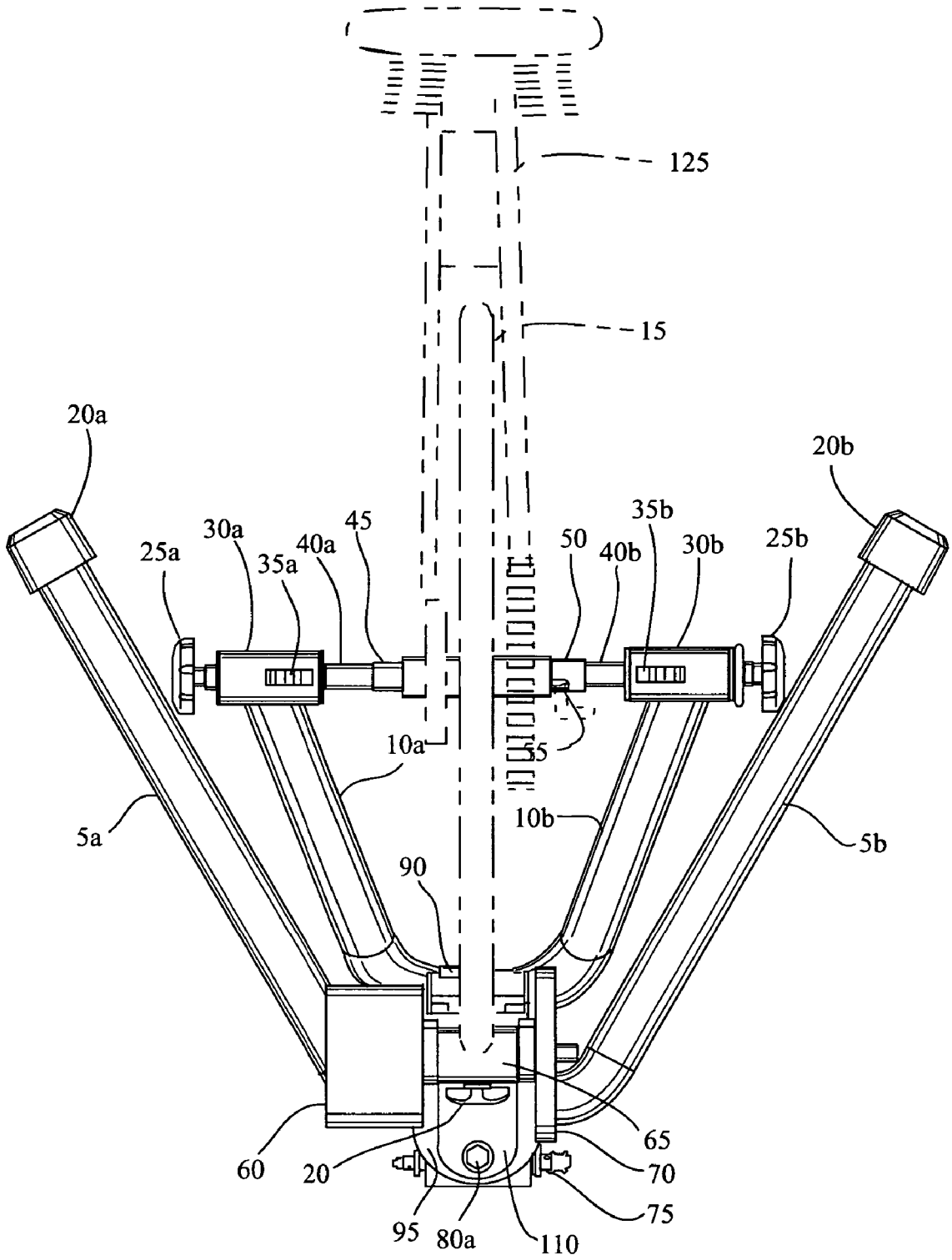
FIG. 3—depicts a top view of the invention.

Referring to FIG. 3, a top view of the invention is depicted where the wheel 15, is securely retained between the left and right wheel securing assemblies 30*a*, 30*b*. The installation of the wheel is performed by providing a sufficient opening between the left axle sleeve 45 and the right axle sleeve 50. The bicycle is arranged so that the left and right axle quick release mechanisms of the wheel 15 are aligned in a common lateral axis with the left and right wheel securing assemblies 30*a*, 30*b*.

The lever of the right axle quick release mechanism is then disposed in the slot 55 of the right axle sleeve 50 while the non-levered left axle of the wheel 15 is positioned with the left axle sleeve 45. The left and right hand operated screw drive assemblies 25*a*, 25*b* are turned until the wheel 15 is securely maintained at approximately a midpoint position of the contact shaft 65 and perpendicular thereto.

Once the positioning of the wheel 15 has been completed, the screw drive assembly locks 35*a*, 35*b* are placed in position and the screw drive assemblies 30*a*, 30*b* are locked by slightly tightening or loosening the screw drives using the adjustment knobs 25*a*, 25*b*.

The spring tension 20 of the adjustable resistance unit 60 is then adjusted to provide the cyclist with the desired tension. To store the bicycle training system, the wheel 15 is removed from the left and right axle sleeves 45, 50 by reversing the steps described above. The locking pin 75 is then pulled laterally to the right until the tubular bicycle support 10*a*, 10*b* and attached components is free to swivel downward toward the common plane of the base support 5*a*, 5*b* as is shown in FIG. 4. The cycling system may now be placed in storage.

The foregoing described embodiments of the invention are provided as illustrations and descriptions. They are not intended to limit the invention to precise form described.

In particular, it is contemplated that functional implementation of the invention described herein may be constructed in various shapes and of different materials. No specific limitation is intended to a particular shape or construction material. Other variations and embodiments are possible in light of above teachings, and it is not intended that this Detailed Description limit the scope of invention, but rather by the claims following herein.

What is claimed:

1. A cyclist training system comprising:

a base support configured to rest on a support surface to support a bicycle in an upright position;

a polymeric pivoting assembly coupled to an intermediate portion of said base support via a horizontal mounting plate attached to said base support to allow said bicycle to nutate about a vertical axis extending from said intermediate portion;

a generally "U" or "V" shaped bicycle support having a middle portion and two end portions, wherein said middle portion is coupled to a flange partially disposed within said polymeric pivoting assembly, and said two end portions are each connected to a bicycle wheel securing assembly; and, a resistance assembly coupled to said bicycle support in proximity to said middle portion, wherein said bicycle wheel securing assemblies are configured to couple to a rear wheel axle of said bicycle, said polymeric pivoting assembly includes a first layer of polymeric inserts fastened onto said horizontal mounting plate and a second layer of polymeric inserts fastened onto said horizontal mounting plate above said first layer with said flange fastened between the first and second layers such that when a user exerts lateral forces on said bicycle, said first and second layer of inserts provide a cushioning effect to bias said bicycle back to said upright position and each of said first layer and said second layer of inserts include at least two inserts having a hardness that is different from each other.

2. The system according to claim 1 wherein said base support comprises a tubular member having a generally hyerboloid shape.

3. The system according to claim 1 wherein at least one of said insert is constructed of an organic polymer having Shore A scale hardness in the range of 40-90 durameters inclusive.

4. The system according to claim 1 wherein said bicycle support comprises a tubular member having a generally hyperboloid shape.

5. The system according to claim 4 wherein said bicycle wheel security assembly comprises a pair of adjustable securing members mounted in opposition along a common lateral axis above said base support.

6. The system according to claim 5 wherein said pair of adjustable securing members being extendable over both sides of a wheel axle of said bicycle disposed between said pair of adjustable securing members.

7. The system accord to claim 1 wherein said resistance assembly comprises a variable friction device which when abutted against a wheel of said bicycle provides sufficient drag to said wheel to simulate various riding conditions.

8. The system according to claim 1 wherein said first and second layers of polymeric inserts are organic and includes;

a first portion having a Shore A scale hardness in the range of 40-90 durameters inclusive; and, a second portion having a Shore D scale hardness in the range of 45-65 durameters inclusive.

9. The system according to claim 8 wherein at least one of said first or said second portions of said assembly organic polymeric inserts includes a convex engagement surface.

10. The system according to claim 1 wherein said polymeric pivoting assembly further comprises a split clamp means adapted to allow said bicycle support to rotate about an axis in common with said base support to a plane approximately in common with said base support means.

11. The system according to claim 10 wherein said split clamp is maintained at an angle to said base support by a locking pin.

12. A cyclist training system comprising:

a tubular base support having:

a first end and a second end;

a generally planar mounting surface disposed on said tubular base support at about a midpoint between said first and second ends;

a substantially "U" or "V" shaped tubular bicycle support having:

a first end having a first adjustable securing member mounted perpendicularly to said first end of said tubular bicycle support; and, a second end having a second adjustable securing member mounted perpendicularly to said second end of said tubular bicycle support;

said first and second adjustable securing members being aligned in opposition along a common lateral axis above said tubular base support and adapted to receive a rear wheel axle of a bicycle to support said bicycle in an upright position;

a generally planar flange disposed on said tubular bicycle support at about a midpoint between said first end and said second end of said tubular bicycle support and aligned generally in parallel to said generally planar mounting surface;

a polymeric pivoting assembly pivotally coupling said generally planar flange to said generally planar mounting surface and;

an adjustable resistance unit coupled to said tubular bicycle support at a position adjacent to said generally planar flange, wherein said polymeric pivoting assembly includes a first layer of polymeric inserts fastened on to said generally planar mounting surface and a second layer of polymeric inserts fastened on to said first layer of polymeric inserts with said generally planar flange being fastened between the first and second layer of inserts wherein each of said first layer and said second layer of inserts include at least two inserts having a hardness that is different from each other.

13. The system according to claim 12 wherein said first and second layers of polymeric inserts are organic and includes;

a first portion having a Shore A scale hardness in the range of 40-90 durameters inclusive; and, a second portion having a Shore D scale hardness in the range of 45-65 durameters inclusive.

14. The system according to claim 13 wherein at least one of said first or said second portion fo said organic polymeric insert includes a convex engagement surface.

15. The system according to claim 12 wherein said polymeric pivoting assembly further comprises:

a cover plate ; and one fastner which couples said polymeric pivoting assembly to at least said generally planar mounting surface.

16. The system according to claim 13 wherein said organic polymer inserts consist essentially of shock absorbing polyurethane.

17. The system according to claim 12 wherein said adjustable resistance unit is repostionable to fit a wheel of said bicycle having a diameter in the range of 16" to 29" inclusive.

18. The system according to claim 12 wherein said polymeric pivoting assembly further comprises a split clamp assembly adapted to allow said tubular bicycle support to rotate about an axis in common with said base support to a plane approximately in common with said base support.

19. The system according to claim 18 wherein said split clamp assembly is maintained at an angle to said base support by a locking pin.

20. A cyclist training system comprising:

a tubular base support having:

a generally hyperboloid shape;

a first end and a second end;

a generally planar mounting surface disposed on said tubular base support at about a midpoint between said first and second ends;

a tubular bicycle support having:

a generally hyperboloid shape;

a first end having a first adjustable securing member mounted perpendicularly to said first end of said tubular bicycle support; and, a second end having a second adjustable securing member mounted perpendicularly to said second end of said tubular bicycle support;

said first and second adjustable securing members being aligned in opposition along a common lateral axis above said tubular base support and adapted to receive a rear wheel axle of a bicycle to support said bicycle in an upright position; and, a generally planar flange disposed on said tubular bicycle support at about a midpoint between said first end and said second end of said tubular bicycle support and aligned generally in parallel to said generally planar mounting surface;

a polymeric pivoting assembly pivotally coupling said generally planar flange to said generally planar mounting surface; and, an adjustable resistance unit coupled to said tubular bicycle support at a position adjacent to said generally planar flange, wherein said polymeric pivoting assembly includes a first layer of polymeric inserts fastened on to said generally planar mounting surface and a second layer of polymeric inserts fastened on to said first layer of polymeric inserts with said generally planar flange being fastened between the first and second layer of inserts, and each of said first layer and said second layer of inserts include at least two inserts having a hardness that is different from each other.

21. The system according to claim 20 wherein said polymeric pivoting assembly coprises at least one insert constructed of an organic polymer having Shore D scale hardness in the range of 45-65 durameters inclusive.

22. The system according to claim 20 wherein said polymeric pivoting assembly comprises at least one insert constructed of an organic polymer having Shore A scale hardness in the range of 40-90 durameters inclusive.

23. The system according to claim 20 wherein said polymeric pivoting assembly further comprises:

a cover plate; and one fastner which couples said polymeric pivoting assembly to at least said generally planar mounting surface.

24. The system according to claim 20 wherein at least said first adjustable securing member comprises a cylindrical locking mechanism which engages on side of an axle of said bicycle along a common axis with said second adjustable securing member sufficient to securely maintain said bicycle in said cyclist training system during use.

25. The system according to claim 24 wherein said second adjustable securing member is simlar to said first securing member but arranged to engage an opposite side of side axle such that said cyclist training system during use cooperatively.

26. The system according to claim 20 wherein at least a portion of said first and said second ends of said tublar base support are enclose in anti-skid ploymeric boots.

27. The system according to claim 20 wherein said polymeric pivoting assembly further comprises a split clamp assembly adapted to allow said tubular bicycle support to rotate about an axis in common with said base support to a plane approximately in common with said base support.

28. The system according to claim 27 wherein said split clamp assembly is maintained during use of said cyclist training system at an angle to said base support by a locking pin.

29. The system according to claim 28 wherein said tubular bicycle support is maintained at said angle from said tubular base support in a range of 35to 70 degree inclusive.

* * * * *